United States Patent [19]

Bruninga

[11] 3,977,063

[45] Aug. 31, 1976

[54] APPARATUS AND METHOD FOR REMOVING A SPRINKLER HEAD FROM A POP-UP SPRINKLER CASING

[75] Inventor: Kenneth J. Bruninga, Mapleton, Ill.

[73] Assignee: L. R. Nelson Corporation, Peoria, Ill.

[22] Filed: Mar. 17, 1975

[21] Appl. No.: 558,626

[52] U.S. Cl. ..... 29/157 C; 29/401 F; 29/446; 81/90 R; 81/125; 239/205

[51] Int. Cl.[2] ..... B25B 13/48; B25B 27/14

[58] Field of Search ..... 81/90 R, 119, 125; 29/240, 157 C, 157 R, 401 R, 401 F, 446, 455; 239/201, 203, 205, 206

[56] References Cited

UNITED STATES PATENTS

| | | | |
|---|---|---|---|
| 922,258 | 5/1909 | Caven | 81/119 |
| 1,302,197 | 4/1919 | Miller et al. | 81/125.1 |
| 1,316,398 | 9/1919 | Steininger | 81/119 |
| 1,408,444 | 3/1922 | Collins | 81/119 |
| 1,512,559 | 10/1924 | Moore | 81/119 |
| 2,015,613 | 9/1935 | Baumgarten | 81/125.1 |
| 2,539,964 | 1/1951 | Montgomery | 81/119 |
| 2,886,998 | 5/1959 | Scott | 81/119 |
| 2,985,242 | 5/1961 | Papa | 81/90 R |
| 3,088,677 | 5/1963 | Coffey et al. | 239/205 |
| 3,301,489 | 1/1967 | Tropeano et al. | 239/201 |
| 3,769,862 | 11/1973 | Miller | 81/119 |
| 3,771,723 | 11/1973 | Ray | 239/206 |

FOREIGN PATENTS OR APPLICATIONS

| | | | |
|---|---|---|---|
| 747,053 | 3/1933 | France | 81/119 |

*Primary Examiner*—Lowell A. Larson
*Assistant Examiner*—Dan C. Crane
*Attorney, Agent, or Firm*—Cushman, Darby & Cushman

[57] ABSTRACT

A tool for gaining access to a pop-up sprinkler head when in a sprinkler casing, and for insertion into and removal from the casing of the sprinkler head; also a method for using the tool for gaining access to the interior of the casing and for sprinkler head removal. A tool consisting of a gripping portion for a gripping a part of the sprinkler head attaching the head to the casing, a handle, a lever interconnecting the handle and gripping portion, and portions for holding a pop-up cover out of engagement with the top of the casing, may be inserted into the casing to effect removal of the head from the casing while not requiring that the cover be manually head out of engagement with the casing top. The tool may also be used merely to allow an individual to gain access to portions of the head within the casing with both hands, one hand not being required to hold the cover out of engagement with the casing top.

10 Claims, 4 Drawing Figures

APPARATUS AND METHOD FOR REMOVING A SPRINKLER HEAD FROM A POP-UP SPRINKLER CASING

BACKGROUND AND SUMMARY OF THE INVENTION

The invention relates to a tool for facilitating insertion into or removal from a pop-up sprinkler casing of a sprinkler head. The invention also relates to a method of removing the sprinkler head from the casing and/or of gaining access to the sprinkler head (especially the part-circle adjustment collars therefor) while in said casing.

On occasion, for replacement or service, it is necessary to remove a pop-up sprinkler head from a pop-up sprinkler casing. Tools have been known in the past for accomplishing this such as shown in U.S. Pat. No. 3,301,489, and as shown by a product produced by Rain Bird Sprinkler Mfg. Corp., of Glendora, California. When using such devices it has in practice been necessary to manually hold the pop-up cover out of engagement with the top of the sprinkler casing against the bias of a spring, insert the device into engagement with formed portions of the sprinkler head interior of the casing, and by rotating the tool while manually holding the pop-up cover out of engagement with the casing top, detach the sprinkler head from the casing. Since it has been necessary to hold the pop-up cover with one hand, rotation of the attachment portion of the head has been difficult, and the whole removal procedure has been laborious and time-consuming. In addition, if it were desired to change the adjustment of the part-circle collars of the sprinkler head, it has been necessary to hold the pop-up cover with one hand while adjusting each collar individually with the other hand.

According to the present invention, a tool is provided that greatly facilitates the insertion into or removal from a pop-up sprinkler casing of a sprinkler head, which tool also may be used to gain access to part-circle adjustment collars or other component parts of the sprinkler head for adjustment or repair thereof. The tool comprises engaging means for engaging a portion of the sprinkler head that attaches the sprinkler head to the casing of the pop-up sprinkler, a handle adapted to be located exteriorly of the casing, a lever interconnecting the handle and the engaging means, and means for holding the pop-up cover of the sprinkler head out of engagement with the casing against the bias of biasing means for the sprinkler head including a hook-like projection extending from the lever at a position between the engaging means and handle adjacent the handle. According to the method of the present invention access to the interior of the casing is possible without the necessity of manually holding the pop-up cover out of engagement with the casing top.

Also, according to prior art devices, a round hole has been provided in the pop-up cover to allow entrance of a tool portion to allow initial lifting of the cover. The provision of such a hole does not lead to the most effective vandalism control. According to the tool of the present invention, a bevel is formed on one edge thereof to allow entrance thereof between the pop-up cover and the housing to provide initial lifting of the cover from the housing.

It is the primary object of the present invention to provide an improved tool and method for gaining access to the interior of a pop-up sprinkler casing and for insertion or removal of a sprinkler head into or from the sprinkler housing. This and other objects of the invention will become clear from an inspection of the detailed description of the invention and from the appended claims.

DETAILED DESCRIPTION OF THE INVENTION

Figure 1:
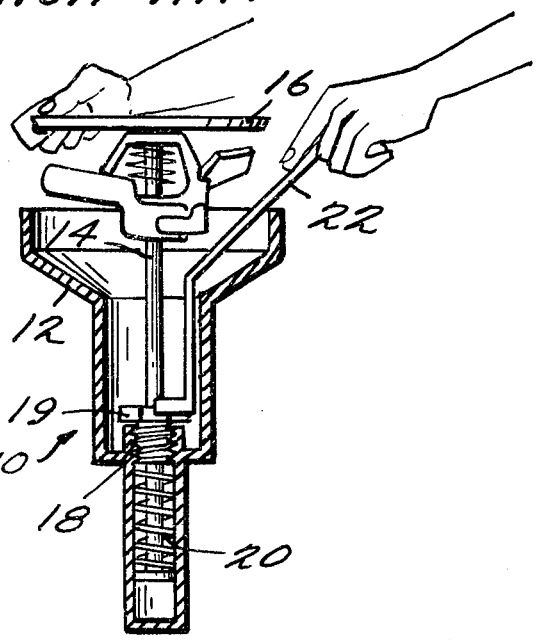
Fig. 1. PRIOR ART
FIG. 1 is a side view, showing the sprinkler casing in cross-section, of a prior art tool being used to remove a sprinkler head from a pop-up sprinkler casing.

In the past it has been necessary to manually hold the cover of a pop-up sprinkler head out of engagement with the casing top of a pop-up sprinkler while a tool is inserted into engagement with means attaching the sprinkler head to the casing, and relative movement therebetween is effected. This operation is shown in FIG. 1 wherein 10 generally shows a pop-up sprinkler having a casing 12, a sprinkler head 14 with a pop-up cover 16 therefor exteriorly threaded, screw-threaded means 18 having a portion 19 thereof for engagement by a tool for rotating the means 18 with respect to the casing 12 for attachment or detachment of the sprinkler head 14 with the casing 12, and spring means 20 for biasing the sprinkler head 14 toward the interior of the casing 12 and the pop-up cover 16 toward engagement with the top of the casing 12. When a specially shaped wrench 22 is used to detach the attaching means 18 from the casing 12, the pop-up cover 16 is held with one hand out of engagement with the top of the casing 12 while with the other hand the tool 22 is inserted into engagement with the collar 19 of attaching means 18, and rotation thereof relative to casing 12 is effected while the cover 16 is still held manually out of engagement with the top of the casing 12. If it is desired to adjust the part-circle adjustment collars of the sprinkler head 14, the cover 16 must again be manually held out of engagement with the top of casing 12 with one hand while only the other hand is free to manipulate the collars or other sprinkler head component parts within the casing 12. A wrench 22 such as shown in FIG. 1 is sold by Rain Bird Sprinkler Mfg. Corp., Glendora, California, and similar wrenches are shown in U.S. Pat. Nos. 1,302,197, 1,316,398 and 1,408,444.

According to the method of the present invention, and by utilizing the tool of the present invention, it is possible to remove a sprinkler head from a pop-up sprinkler casing without having to manually hold the pop-up cover out of engagement with the casing top with one hand. Also, it is possible to gain access to the portions of the sprinkler head within the interior of the casing with both hands (so that both part-circle adjustment collars can be moved at the same time, etc.) since it is not necessary to hold the pop-up cover out of engagement with the casing top with one hand. An exemplary pop-up sprinkler that may be acted on according to the present invention is shown generally at 30 in FIGS. 2 and 3. Such a pop-up sprinkler may be an Impact Rotor Pop-Up model GS23, manufactured by L. R. Nelson Corporation, Peoria, Ill., or any one of a number of similar pop-up sprinklers, such as those shown in U.S. Pat Nos. 3,088,677 and 3,434,664.

The sprinkler 30 includes a casing 32 having a top surface 33 thereof and an exteriorly threaded tubular inner member 34, and a sprinkler head 36. The sprinkler head 36 may comprise a body portion 38, a grippable means such as a nut 40 for attaching the head 36 to casing 32, a terminating collar 42, biasing means such as a spring 44, a circular pop-up cover 46, and a nozzle 48. The grippable means 40 preferably includes a hexagonal interiorly threaded nut-like member adapted to be threaded over the member 34 of casing 32 to effect attachment of the sprinkler head 36 to the casing 32. The member 40 may take other forms, however.

A biasing means such as spring 44 is positioned between nut 40 and collar 42 for biasing the sprinkler head toward the interior of casing 32, and for biasing the circular pop-up cover 46 into engagement with the casing top 33. Other suitable biasing means, as are conventional in the art, may also be employed. Additionally, part-circle adjustment collars 50 or the like may be included with sprinkler 30. The sprinkler 30 itself forms no part of the present invention, but merely is the structure with which the tool according to the present invention may be used and the method according to the present invention may be practiced.

Figure 3:
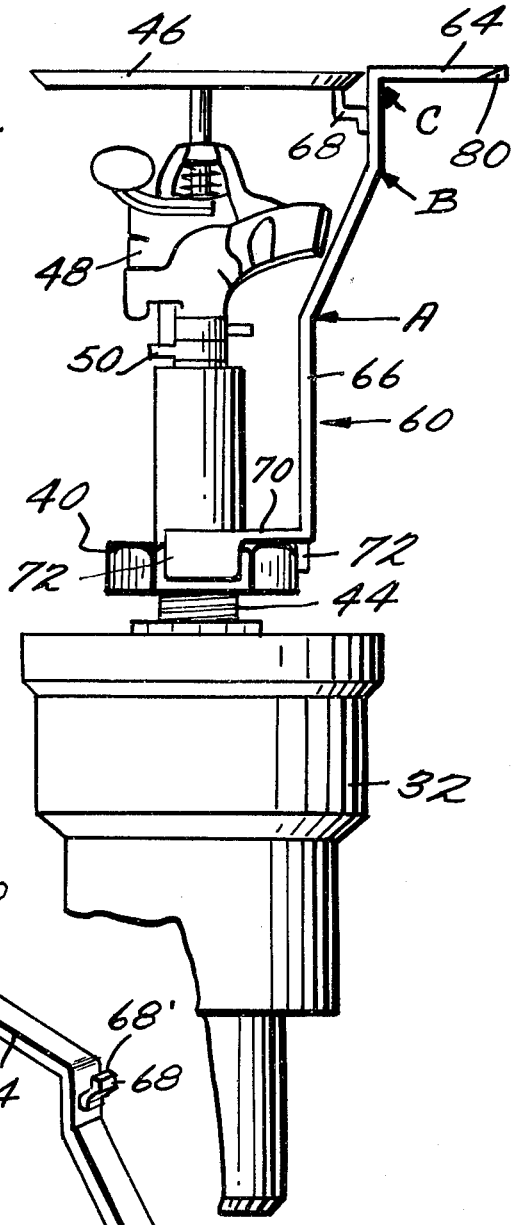
FIG. 3 is a view similar to FIG. 2 showing the sprinkler head as it is being retracted from the casing after detachment thereof.
Figure 2:
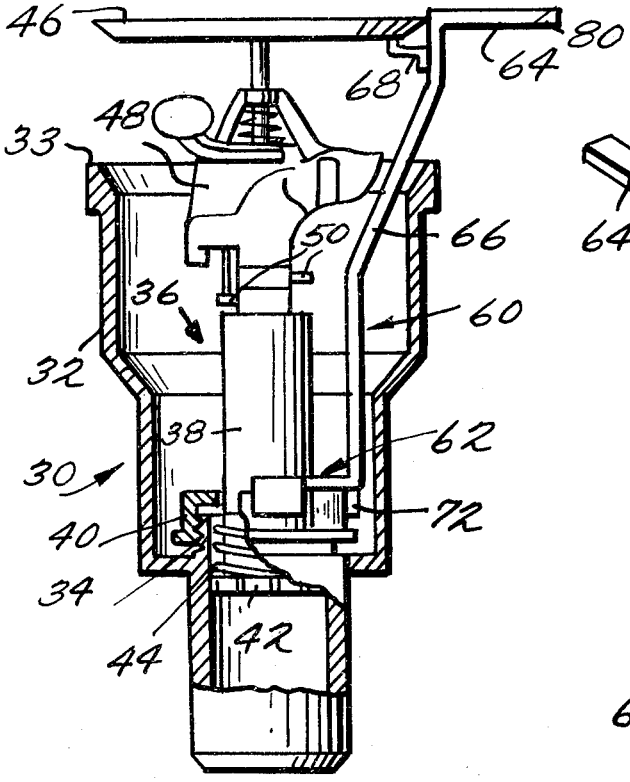
FIG. 2 is a view similar to FIG. 1 showing the tool of the present invention in use for gaining access to the interior of a pop-up sprinkler casing and/or for removing a sprinkler head from a pop-up sprinkler casing.
Figure 4:
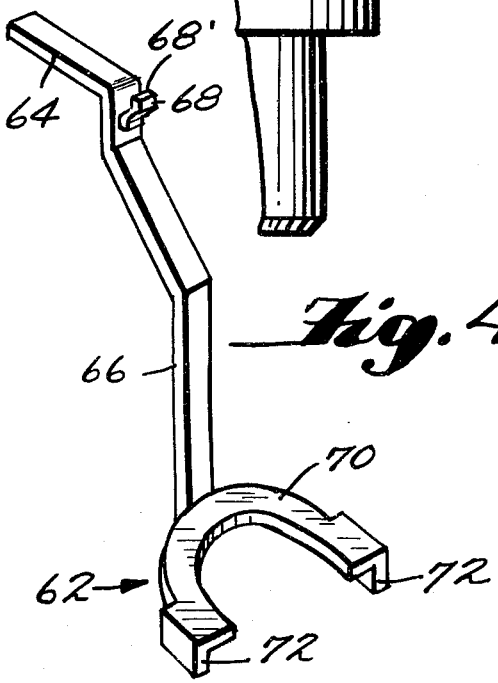
FIG. 4 is a perspective view of an exemplary tool according to the present invention.

A tool according to the present invention is shown generally at 60 in FIGS. 2–4. The tool 60 generally consists of an engaging means 62 at one end thereof and a handle means 64 at the other end thereof, the handle means adapted to be located exteriorly of the casing 32. Interconnecting the handle 64 and the engaging means 62 is a lever 66 or the like. The lever 66 preferably is an elongated metal plate-like member, having bends at points A, B, and C thereof, the portion AB thereof when the tool is in use extending outwardly from the interior of the casing towards the circumference of the circular cover 46, and the portion BC being generally perpendicular to the plane of cover 46. The engaging means 62 preferably includes a plate-like member 70 generally perpendicular to the portion of lever 66 to which it is attached, and a plurality of flat portions 72 extending generally perpendicularly to the plate 70 and adapted to engage spaced surfaces of the member 40. Means are also provided on tool 60 for maintaining the cover 46 out of engagement with casing top 33 without the necessity of manually holding it out of engagement. Such a means preferably takes the form of a hook portion 68 extending outwardly at an angle from the portion B-C of lever 66 and having a surface 68′ thereof for engaging the bottom of circular pop-up cover 46. The cover 46 may have specially formed recesses or sets of projections thereon for cooperation with surface 68′. The hook-member 68 cooperates with the plate 70 to compress the spring 44 and maintain the cover 46 out of engagement with the casing top 33. The lever 66 between the hook 68 and plate 70 is so dimensioned that when the plate 70 abuts the top of member 40 and the hook 68 surface 68′ abuts the bottom surface of cover 46 the spring 44 is in a compressed state and the cover 46 is out of engaging relationship with the casing top 33, as shown in FIG. 2 and allows free access to the casing interior. The hook-like projecting member 68 is preferably a metal member of the shape shown in the drawings, and is welded to the lever portion BC, although it can be formed as a cutout from lever 66, or fixed thereto by other means.

The tool 60 according to the present invention also preferably has one edge (such as edge 80) of the handle 64 thereof beveled so that it may be inserted between the pop-up cover 46 and the housing 32 to provide initial lifting of the cover. This eliminates the need to provide a hole in the top of the cover for the introduction of a wrench part, as is provided in the prior art structure shown in FIG. 1.

The method of utilization of the tool 60 according to the method of the present invention will now be set forth. When it is desired to remove a sprinkler head 36 from a pop-up sprinkler casing 32, the cover 46 is manually lifted out of engagement with the casing top 33 by inserting edge 80 between the cover 46 and casing top 33, a large enough space being provided between the cover 46 and casing top 33 to allow insertion of the portion 62 of tool 60 into the casing 32. The engaging end 62 of tool 60 is then inserted into the casing 32, and the plate 70 is placed flush against the top of sprinkler head attaching member 40, the flat portion 72 engaging various surfaces of the member 40. The hook 68 is then positioned under the cover 46 (it will automatically be positioned thereunder when the plate 70 is flush against the top of member 40), and the manual hold on the cover 46 is then released (see FIG. 2 position). Then the tool 60 may be rotated until the member 40 is detached from the casing portion 34, and the whole sprinkler head 36 may then be lifted out of the casing 32 by merely lifting up on handle 64 (see FIG. 3 position). A new or repaired sprinkler head 36 may then be inserted into the casing 32 by placing the hook 68 and plate 70 of tool 60 between the cover 46 and attaching member 40 thereof, lowering the whole head 36 into the casing by holding the handle 64 and moving it downwardly, and rotating the tool 60 to attach the member 40 to the portion 34.

According to the present method, it is also possible for an individual to gain access to component parts of the sprinkler head 36 located interiorly of the casing 32 with both hands. This is accomplished by lifting the cover 46 against the bias of spring 44 out of engagement with casing top 33, inserting end 62 of tool 60 into casing 32, placing plate 70 flush against the top surface of member 40 and hook member 68 against the bottom surface of cover 46, and releasing manual hold of the cover 46. The tool 60 will keep the cover 46 out of engagement with the casing top 33 a distance sufficient to allow an individual's hands to pass therebetween, and the individual has both hands free to simultaneously adjust the part-circle adjustment collars 50, or otherwise act on the sprinkler head 36.

While the invention has been herein shown and described in what is presently conceived to be the most practical and preferred embodiments, it will be apparent to one of ordinary skill in the art that many modifications may be made thereof within the scope of the invention, thus it is intended that the invention be accorded the broadest interpretation of the appended claims in order to emcompass all equivalent structures and methods.

What is claimed is:

1. A method for removing a pop-up sprinkler head from a pop-up sprinkler casing, the sprinkler head having a grippable member for screw-threaded detachable engagement with the casing, a circular pop-up cover, and means for biasing the sprinkler head toward a position wherein it is contained by the casing and for biasing the pop-up cover into engagement with the top of the casing, said method comprising the steps of:

a. disengaging the pop-up cover from engagement with the top of the casing,
b. manually holding the pop-up cover out of engagement with the casing top against the bias of the means biasing the pop-up cover toward engagement with the top of the casing,
c. inserting a portion of a tool into the casing and simultaneously positioning a portion of said tool in operative engagement with a bottom surface of said circular pop-up cover, said tool including a gripping means at one end thereof adapted to grasp said grippable member, and a handle member at the other end thereof adapted to be located exteriorly of said casing to be grasped by the hand of an operator, and a lever interconnecting said handle and gripping means, said lever having attached thereto adjacent the handle-engaging end thereof a projecting member having a surface thereof for engaging the bottom surface of said circular pop-up cover, said pop-up cover being automatically held out of engagement with the casing against the bias of the biasing means when said gripping means engages said grippable member and said projecting member surface engages the bottom surface of said pop-up cover,
d. releasing manual hold of the pop-up cover, and
e. detaching the sprinkler head from the casing by effecting rotary movement of the grippable member with said tool.

2. A method for gaining access to the interior of a pop-up sprinkler casing and adjusting part-circle adjustment means therein, said casing containing a pop-up sprinkler head, having a pair of part-circle adjustment collars, the sprinkler head being operatively connected to the casing and including a circular pop-up cover and means for biasing the sprinkler head toward a position wherein it is contained by the casing and for biasing the pop-up cover into engagement with the top of the casing, said method comprising the steps of:

a. disengaging the pop-up cover from engagement with the top of the casing,
b. manually holding the pop-up cover out of engagement with the casing top against the bias of the biasing means,
c. positioning a portion of a tool into the casing and simultaneously positioning a portion of said tool in operative engagement with a bottom surface of said circular pop-up cover, said tool including a plate-like member at one end thereof for engaging an interior portion of said pop-up sprinkler, and a handle member at the other end thereof adapted to be disposed exteriorly of said casing, and a lever interconnecting said handle and plate-like member, said lever having attached thereto adjacent the handle-engaging end thereof a projecting member having a surface thereof for engaging the bottom surface of said circular pop-up cover, said pop-up cover being automatically held out of engagement with the casing against the bias of the biasing means a distance sufficient to allow a hand to pass therebetween into the interior of the casing when the plate-like member engages the provided interior portion of said sprinkler and said projecting member surface engages the bottom surface of said pop-up cover,
d. releasing manual hold of the pop-up cover, and
e. simultaneously adjusting both of said part-circle adjustment collars after releasing manual hold of the pop-up cover.

3. A tool for use in inserting or removing a sprinkler head into or from a pop-up sprinkler casing, the sprinkler head having a grippable member for detachable screw-threaded engagement with the casing, a circular pop-up cover, and means for biasing the sprinkler head toward a position wherein it is contained by the casing and for biasing the pop-up cover into engagement with the top of the casing, said tool comprising:

a. an elongated lever having two ends, a portion of said lever extending when in use outwardly from the interior of the casing generally to the circumference of the circular pop-up cover,
b. a handle member operatively connected to one end of said lever, said handle member adapted to be grasped by a hand to effect arcuate movement of said tool,
c. gripping means located at the opposite end of said lever as said handle member, said gripping means including a plurality of projections for gripping said grippable member for effecting rotary movement thereof,
d. a projecting member adjacent said handle end of said lever and extending therefrom, said projecting member having a surface thereof for engaging a bottom surface of the circular pop-up cover, and
e. the length of said lever between said gripping means and said projecting member being great enough so that the pop-up cover is held out of engagement with the casing top against the bias of the biasing means when the gripping means grips the grippable member while the projecting member surface engages the bottom of the circular pop-up cover.

4. A tool as recited in claim 3 further comprising a plate-like member operatively connected to said gripping means, the plane of said plate-like member being generally perpendicular to the planes of said projections of said gripping means, said plate-like member adapted to engage a top surface of the grippable member, the length of said lever between said plate-like member and said projecting member being great enough so that the pop-up cover is held out of engagement with the casing top against the bias of the biasing means when the plate-like member engages a top surface of the grippable member while the projecting member surface engages the bottom of the circular pop-up cover.

5. A tool as recited in claim 3 wherein said lever has a number of differently directed portions intermediate the ends thereof including a first portion operatively connected to said handle and extending when in use in a plane generally perpendicular to the plane of said pop-up cover.

6. A tool as recited in claim 5 wherein said handle extends in a plane generally perpendicular to said first portion.

7. A tool as recited in claim 5 further including a second lever portion, said second lever portion being the portion of said lever extending outwardly from the interior of the casing during use thereof generally to the circumference of the circular pop-up cover, said second lever portion being operatively connected to said first lever portion and making an oblique angle therewith.

8. A tool as recited in claim 7 further including a third lever portion operatively connecting said second lever portion and said gripping means, said third lever portion extending in a plane generally parallel to the plane of said first lever portion.

9. A tool as recited in claim 5 wherein said projecting member is operatively connected to said first lever portion.

10. A tool as recited in claim 3 wherein one edge of said handle is bevelled for allowing the insertion of the handle between the pop-up cover and casing for prying of the pop-up cover out of engagement with the top of the casing.

* * * * *